US006491342B1

(12) United States Patent
Smith

(10) Patent No.: US 6,491,342 B1
(45) Date of Patent: Dec. 10, 2002

(54) RECLINING CHAIR

(76) Inventor: Nathaniel Smith, 46 Front St., Holliston, MA (US) 02746

( * ) Notice: Subject to any disclaimer, the term of this patent is extended or adjusted under 35 U.S.C. 154(b) by 0 days.

(21) Appl. No.: 09/697,230

(22) Filed: Oct. 26, 2000

Related U.S. Application Data

(60) Provisional application No. 60/161,979, filed on Oct. 28, 1999.

(51) Int. Cl.[7] ..... A47C 1/02
(52) U.S. Cl. ..... 297/68; 297/84
(58) Field of Search ..... 297/330, 83, 84, 297/DIG. 7, 316, 329, 68

(56) References Cited

U.S. PATENT DOCUMENTS

| | | | | |
|---|---|---|---|---|
| 426,601 A | | 4/1890 | Muhl | |
| 1,837,911 A | | 12/1931 | Lillibridge | |
| 2,299,538 A | | 10/1942 | Goldstein | |
| 2,798,534 A | | 7/1957 | Curtis | |
| 2,927,630 A | * | 3/1960 | Sichelschmidt | 297/83 |
| 3,033,612 A | | 5/1962 | Schliephacke | |
| 3,039,816 A | | 6/1962 | Schliephacke | |
| 3,103,381 A | * | 9/1963 | Schliephacke | 297/84 |
| 3,363,942 A | * | 1/1968 | Fletcher | 297/84 |
| 4,383,714 A | | 5/1983 | Ishida | |
| 4,519,647 A | | 5/1985 | Rogers, Jr. | |
| 4,919,478 A | * | 4/1990 | Tacker | 297/68 X |
| 4,957,302 A | | 9/1990 | Maxwell | |
| 5,244,252 A | | 9/1993 | Serber | |
| 5,348,367 A | * | 9/1994 | Mizelle | 297/83 |
| 5,564,781 A | | 10/1996 | Pine | |
| 5,857,739 A | * | 1/1999 | Smith | 297/68 X |

FOREIGN PATENT DOCUMENTS

| | | |
|---|---|---|
| GB | 671081 | 4/1952 |

* cited by examiner

*Primary Examiner*—Peter M. Cuomo
*Assistant Examiner*—Stephen Vu
(74) *Attorney, Agent, or Firm*—Wolf, Greenfield & Sacks, P.C.

(57) ABSTRACT

A reclining chair has a frame and body support including a seat, back rest and leg rest. The body support is carried on a pair of cams mounted on a track to rock between an upright and fully reclined position. In the fully reclined position the chair occupant is placed in a zero gravity position. The leg rest which is pivotally connected to the seat continuously and smoothly moves with respect to the seat as the body support moves from one position to another.

28 Claims, 5 Drawing Sheets

RECLINING CHAIR

CROSS REFERENCE TO RELATED APPLICATION

This application is related to and claims the benefit of the filing date of U.S. Provisional Application No. 60/161,979, filed Oct. 28, 1999. U.S. Provisional Application No. 60/161,979 is hereby incorporated by reference in its entirety.

INTRODUCTION

This application relates to motion furniture and more particularly to recliner chairs.

Most conventional reclining chairs presently available that have mechanisms which enable a chair to move between upright and fully reclined positions, have a body support that includes a back rest, seat and leg rest that move as an assembly about a fixed or movable pivot. Most commonly those chairs that employ a movable pivot include either a complex and expensive mechanical linkage or a track system that moves the pivot with respect to the base of the chair as the chair occupant, by means of pressure against the back rest, reclines the chair or by means of pressure on the leg rest moves the chair to the upright position. Those chairs that have fixed pivots have limited motion between the extreme positions and most do not allow the body support to provide a zero gravity orientation of the occupant's body even when the chair is fully reclined. Furthermore, most conventional recliners do not move in a forward direction a sufficient distance to bring the seat to substantially a horizontal plane and therefore those recliners are somewhat difficult to alight from particularly for aged or handicapped persons.

Other conventional recliners that enable the body support to move to a zero gravity reclined position are not as comfortable in that position as they could be for the chair occupant when he/she attempts to watch television or read. The problem is principally the result of the head rests of the recliners being disposed at a fixed angle with respect to the major portion for the back rest and being oriented too far back for the occupant to see over his/her legs to view a television screen unless the screen is mounted in an elevated position such as a bookcase well above table top height. Such chairs are also not conducive to conversation for the occupant with another sitting in the room generally in front of the recliner.

In view of the foregoing, it is an object of the present invention to provide an improved recliner.

In one illustrated embodiment of the present invention, a recliner is provided with a cam mechanism that enables the chair to move between the front and rearmost positions of the body support in a rocking-like action and provides a longer motion for the body support so that it can achieve a fully reclined position wherein the body of the occupant is in a zero gravity position and wherein the seat of the body support is substantially horizontal when the chair is in an upright position so that the chair occupant can alight from the chair without difficulty.

In another illustrative embodiment of the invention, the chair has a brake that forms part of the cam mechanism so as to enable the chair to be locked in any position between the fully reclined and fully upright positions provided by the cam.

In another illustrative embodiment of the invention, the leg rest is pivotally connected to the body support and continually moves from a stored position underneath the front edge of the seat when the chair is upright to an elevated position wherein it is at an angle of approximately 130° to the seat when the seat is filly reclined so as to elevate the lower legs of the occupant above the heart. The transition of the leg rest from the stored position to the elevated position is smooth and continuous as the chair moves between the upright and fully reclined positions.

BRIEF FIGURE DESCRIPTION

Figure 2:
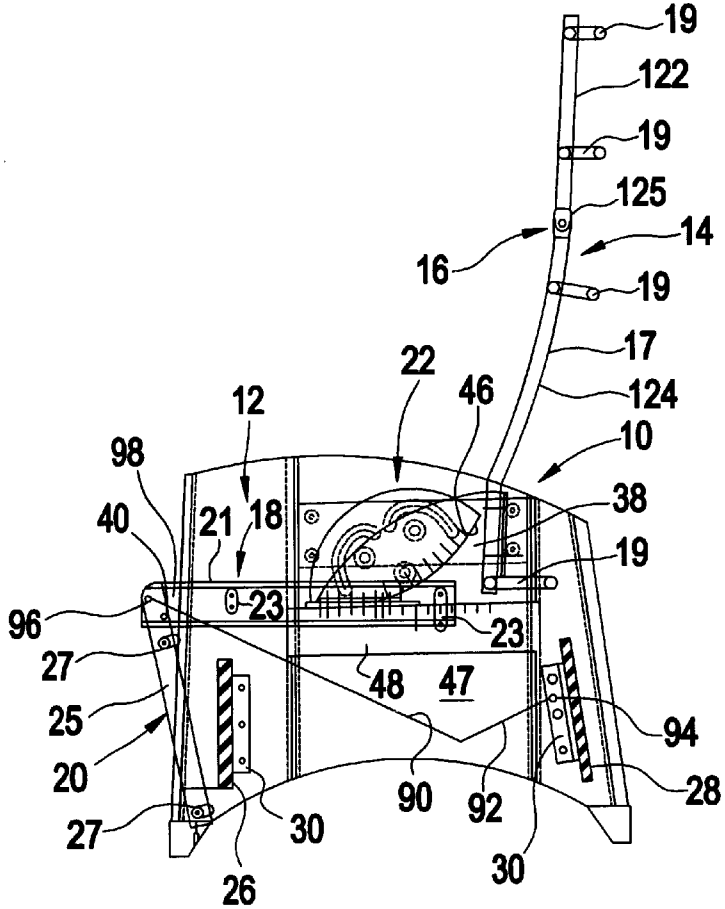
FIG. 2 is a partially diagrammatic, side view of the reclining chair without upholstery, embodying this invention, and shown in the upright position.
Figure 4:
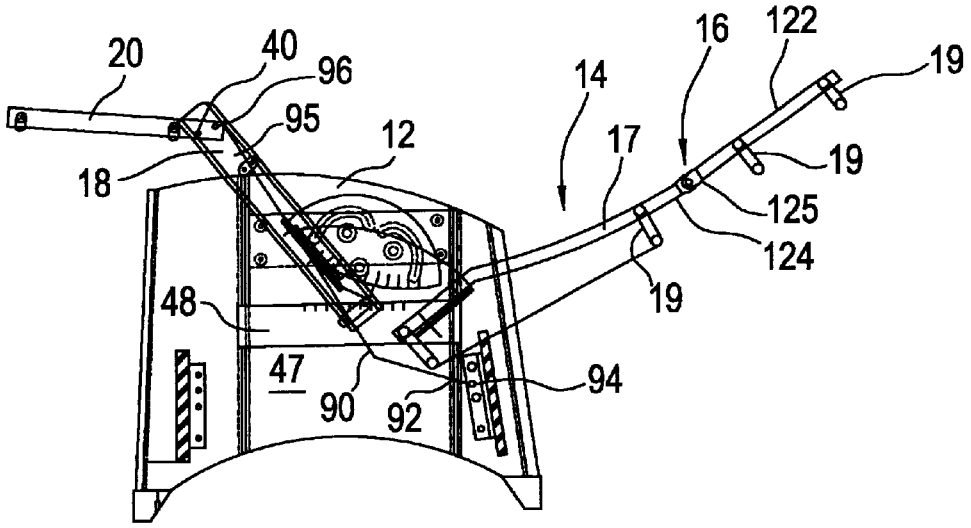
Figure 6:
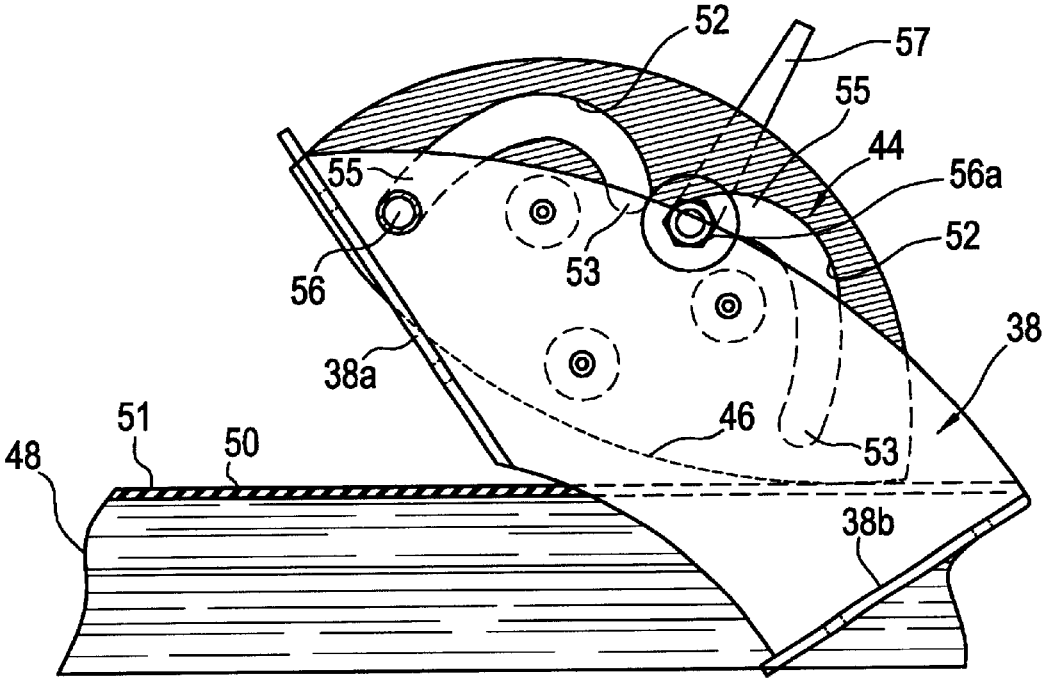
Figure 5:
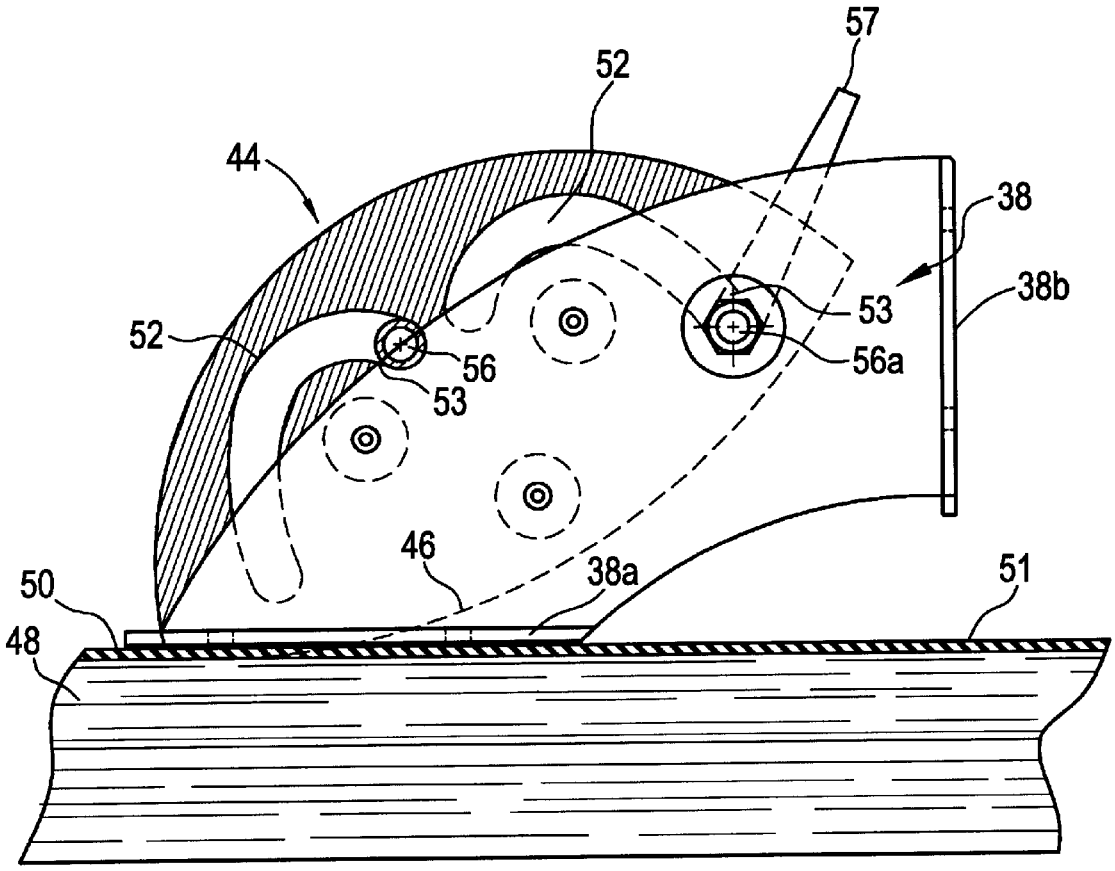
Figure 7:
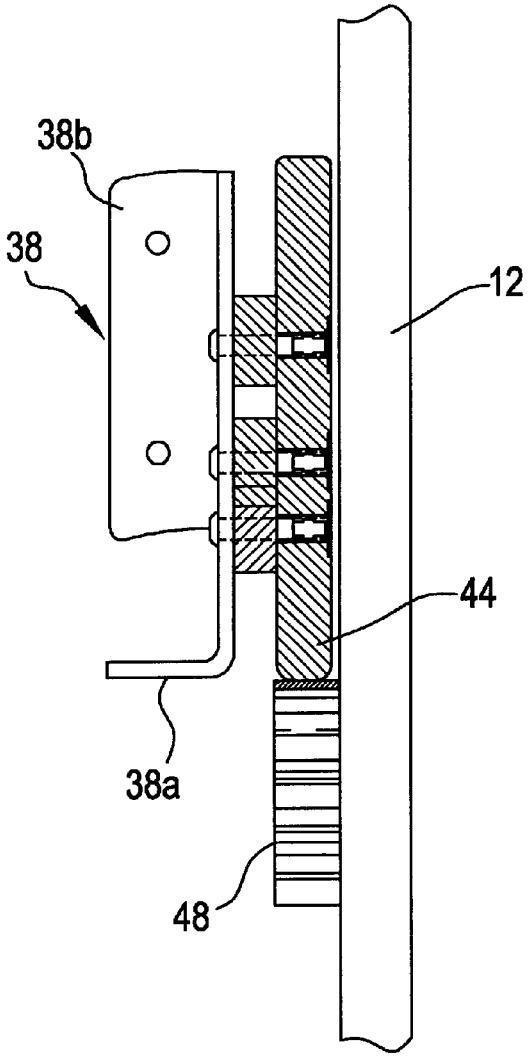
Figure 8:
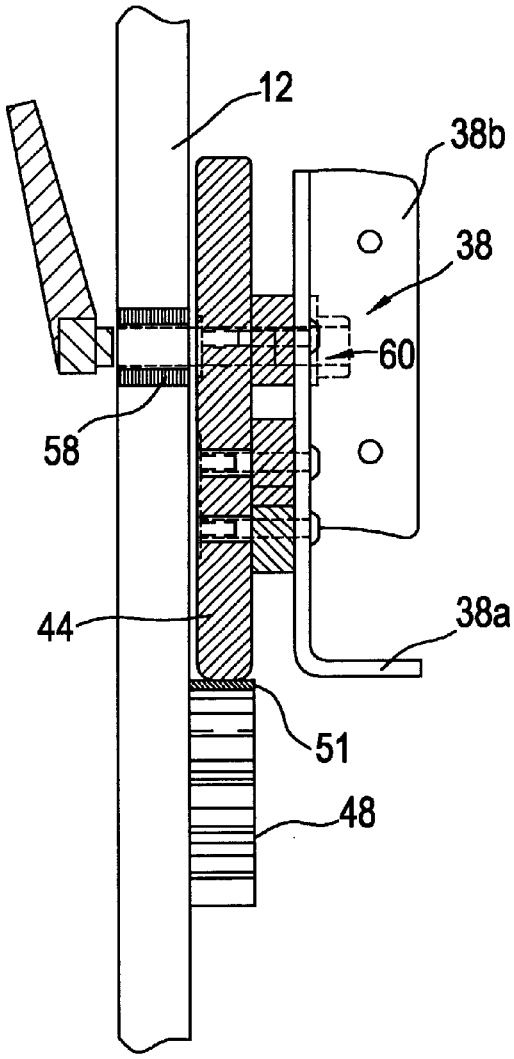

FIGS. 5 and 6 are fragmentary views of the rocker mechanism that enables the body support of the chair to move between the positions shown in FIGS. 2 and 4, respectively; and FIGS. 7 and 8 are front cross-sectional views of the rocker mechanisms on the right and left sides of the chair, respectively.

DETAILED SPECIFICATION

Figure 1:
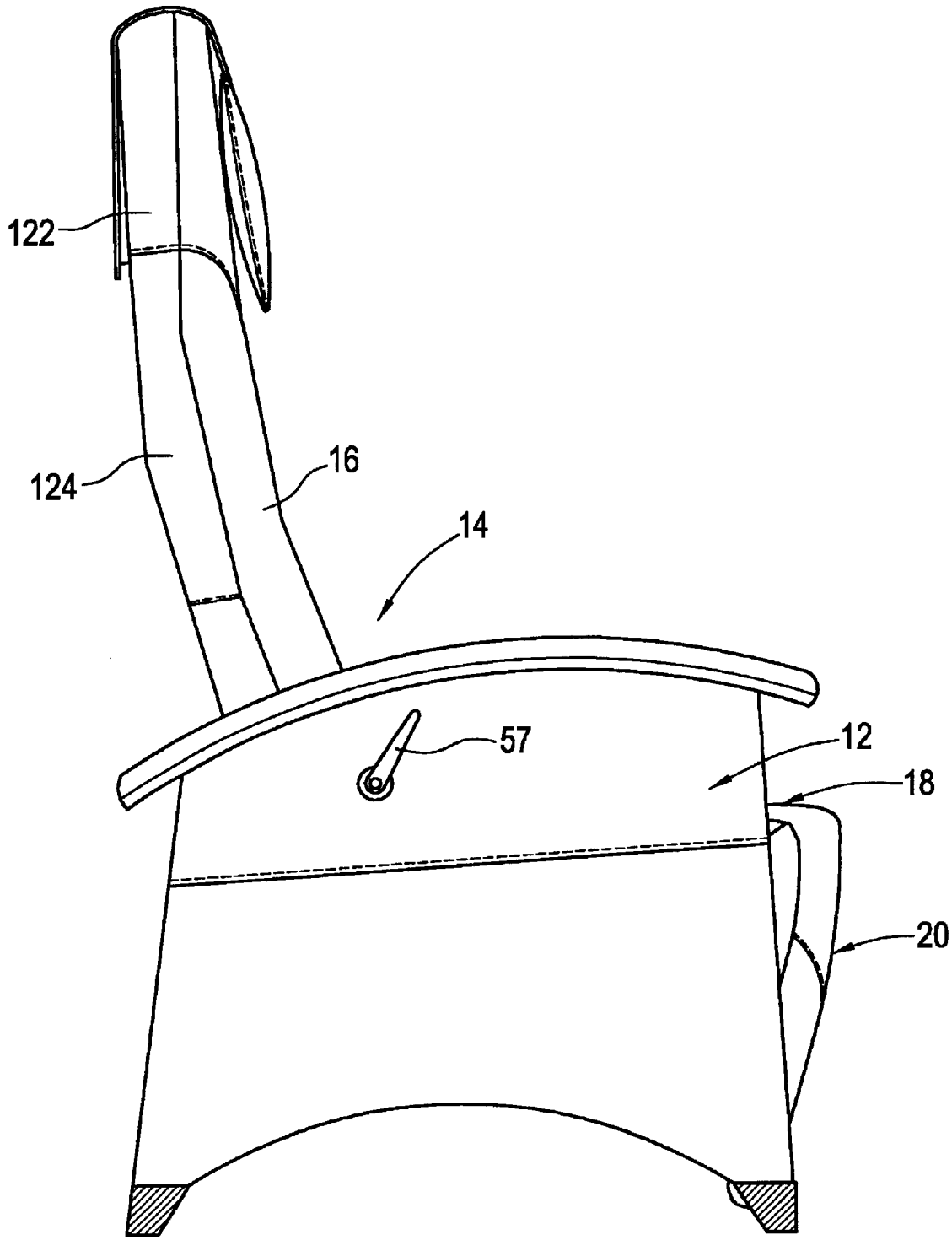
FIG. 1 is a side view of a chair in an upright position, embodying this invention.

The chair 10 embodying the present invention and shown in the drawings includes a pair of vertical side panels (one shown) 12 that rest on the floor and define the two arms of the chair and serve as the main chair frame. A body support assembly 14 comprising a backrest 16, seat 18 and leg rest 20 is disposed between the two panels 12. Also disposed between the two panels and essentially hidden from view is a reclining mechanism 22 that enables the body support 14 to move between the two extreme positions of the chair, namely, the upright position shown in FIGS. 1 and 2 and the zero gravity fully reclined position wherein the legs are bent at the hips with respect to the torso and slightly bent at the knees, and the lower portions of the legs are elevated above the heart, shown in FIG. 4. The body support 14 may be locked in the extreme positions as well as in an infinite number of semireclined positions, as exemplified in FIG. 3, between the two extremes as selected by the user. The side panels 12 may be made of medium density fiber board although numerous other materials may be used instead. In the embodiment shown, the panels 12 are connected together by front and back spreaders 26 and 28 secured to the inner surfaces of the panels by brackets 30. The side panels 12 and spreaders 26 and 28 form the base frame of the chair, and it should be understood that the base frame may take many, widely different forms. For example, the chair may have four comer legs connected together by side and cross braces, and they may be upholstered in countless different styles.

Figure 3:
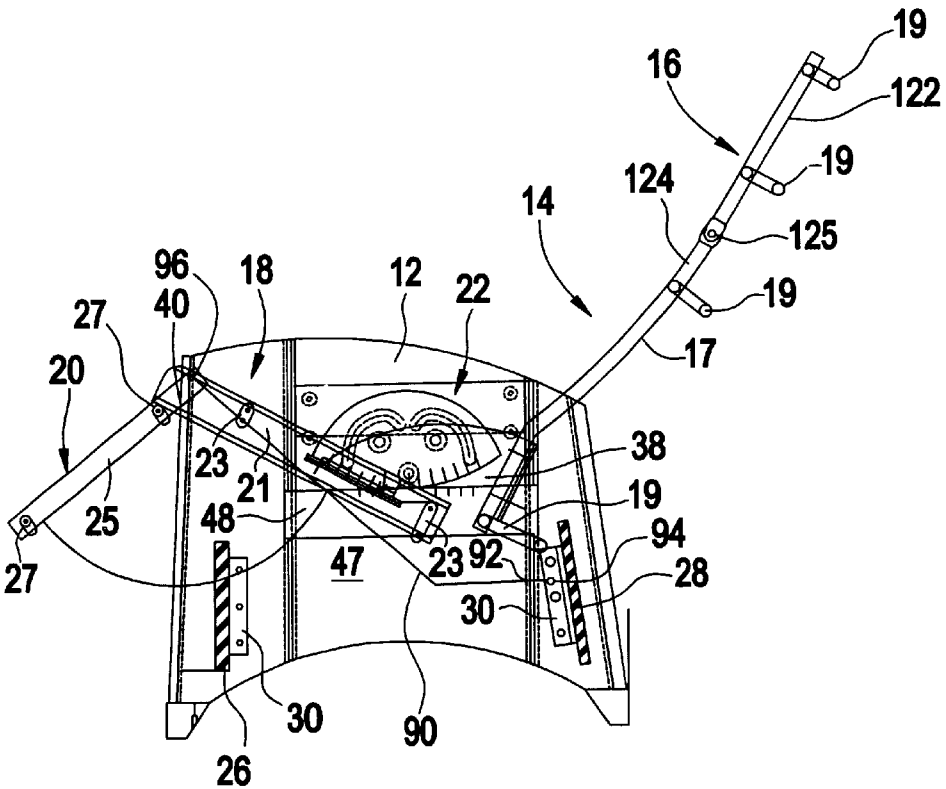
FIGS. 3 and 4 are views similar to FIG. 2 but with the chair shown in an intermediate or a partially reclined position and a fully reclined position, respectively.

The backrest 16 of the body support 14 as shown in FIGS. 2–4 may be composed of a tubular metal frame having side and cross members 17 and 19, respectively, and the seat 18 may, for example, be made up of a metal frame composed in this example of I-beam shaped side members and tubular metal cross members 21 and 23, respectively. The leg rest 20 may also be made up of a metal frame having side and cross members 25 and 27. The backrest 16 and seat 18 are shown rigidly connected together by means of brackets 38, one on each side of the body support, that in the embodiment shown, maintain the angular relationship of the backrest and seat constant. The brackets 38 have flanges 38*a* and 38*b* that support the seat 16 and backrest 18, respectively. The leg rest 20 is pivotally connected to the front end of the seat by a fixed pivots 40. Unlike the relationship between the backrest 16 and seat 18, in the embodiment shown the angular relationship between the seat 18 and leg rest 20 is not fixed, but rather varies as the body support 14 moves between the upright and fully reclined, zero gravity position as is explained more fully below. While the seat, backrest and leg rest are described above as being made of metal construction, it should be understood that they may be made of other materials such as wood and be fully upholstered as is well known in the art.

Each bracket 38 is mounted on a separate rocker cam 44 having an arcuate lower edge 46 that rides on a track 48 in turn secured to the inner side 47 of one of the side panels 12 that define the sides of the base frame of the chair. While in the embodiment illustrated the arcuate lower edge is of constant radius, that is, it is a circular arc, the invention is not limited to that configuration. Rather, for example, the arcuate surface may have larger or smaller radii at its ends to alter the apeed and ease of operation of the chair when closer to upright and fully reclined positions of the body support 14 than when the body support is in an intermediate position. A track 48 is provided on each side (see FIGS. 7 and 8) and they support the rocker cams 44 on each side of the body support assembly 10. The arcuate edge 46 of each cam rides on the surface 50 of its track 48. For smoother and quieter operation, each surface 50 may have a layer 51 of rubber or similar material on which the edge 46 rests. The cams may be made of wood or any other suitable material that has sufficient strength and wear resistance to carry the body support 10 and the occupant of the chair and sustain stress imposed by the rocking action on the tracks.

In FIGS. 5 and 6 one track and cam assembly is shown in detail. While only one side of the mechanism is described, it should be appreciated that the parts are duplicated on each side of the chair as shown in FIGS. 7 and 8. In accordance with one important aspect of this invention, the rocker cam has a pair of curved slots 52 into which separate posts 56 and 56a extend that are fixed in position on the side of the base frame and in the embodiment shown, in the panel 12. If the side panels 12 are made of wood or other comparable material, it is desirable to include in each of the panels heavy duty plates (not shown) made of steel or comparable material to carry the load imposed by the posts 56 and 56*a*. The posts may be secured directly to the plates and the plates in turn may be mounted in or on the side panels 12. The slots and posts comprise a guide for the cam as explained in detail below. When the chair is in the upright position, by virtue of the cam face 46 being rocked on the track 48 to the forwardmost position shown in FIGS. 2 and 5 , the posts 56 and 56*a* are disposed at the rearmost ends 53 of the slots 52. When the body support is moved to the fully reclined, zero gravity position, the cam face 46 rocks rearwardly on the track 48 until the posts 56 and 56*a* engage the front ends 55 of the slots 52 as in FIG. 6. The posts and slots confine the rocking motion of the cam to a very precise path and prevent any translational motion of the cam, that is, any sliding of the cam face 46 on the supporting surface 50 of the track 48. As a result, any given point on the arcuate face 46 of the cam 44 will always align precisely with the same point on the track 48 as the cam rocks back and forth on it. While in the illustrative embodiment the posts are fixed to and/or carried by the side members 12 and the slots are in the moving cams 44, the parts may be reversed with the posts mounted on and movable with the cams and the slots 52 fixed on or formed in the side member 12. The shape of the curved slots is a function of the radius of curvature of the cam face 46 and the distance of the posts 56 and 56*a* from the surface of the track 48.

One of the posts 56*a* on one side of the chair frame that extends through the rearmost of the two slots 52 serves as part of a brake assembly to enable the user to lock the body support in either the upright or fully reclined position or in any selected position between the extreme upright and fully reclined zero gravity positions through which the body support is capable of moving. The post 56*a* carries a handle, knob or other actuator (handle 57 shown) and extends through a threaded bushing 58 in the side panel so that when the actuator is turned, the nut and washer 60 carried by the post will be drawn firmly against the inner surface of the cam so as to clamp the cam against the side panel 12 or against a brake pad or other expedient carried by the panel and lock the body support 10 in the fixed position selected by the chair occupant. The brake assembly may take other forms and be independent of the posts 56 and 56*a* but should be located on the body support or base frame so that it can be conveniently operated by the chair occupant while seated. The use of a lever-type handle as illustrated also has advantages over other shapes in that it enables larger threads to be used so that the lock requires a limited turn of only approximately 45°–90° between the fully released and locked conditions.

The angular relationship between the seat and leg rest is controlled by a drive link 90 that is pivotally connected at its rear end 92 at a fixed point on the base frame such as rear spreader 28, as suggested by the pivot 94 in FIGS. 2–4. The other end 95 of the drive link 90 is connected to the leg rest frame above the leg rest pivot 40, by means of a pivotal connection 96. The drive link 90 pulls on the leg rest at the connection 96 as the seat moves from the substantially horizontal sitting position of FIG. 2 to the fully reclined position of FIG. 4, which action causes the leg rest to rotate about its pivotal connection 40 to the seat in a clockwise direction with respect to the seat 18. In the fully reclined, zero gravity position the seat 18 is disposed at approximately 58° from the horizontal while in the upright position the seat is tilted upwardly in a forward direction just a few degrees from the horizontal, preferably approximately 2°–5°. That slight angle of the seat enables the user to move in and out of the seat more easily than with conventional recliners that frequently have seats at an upward angle of approximately 12°–18° when upright.

It is evident upon viewing of FIGS. 2–4 that the angular relationship between the seat and leg rest uniformly changes as the seat moves to the fully reclined position. The angular relationship of the leg rest and sets changes at a substantially constant rate as the body support 14 moves from one position to another between the upright and filly reclined positions. This relationship distributes the load imposed by the leg rest evenly throughout the movement of the body support, making it easier to move the body support from one position to another, in contrast to other recliners that require greater effort to move the body support at the extreme ends of permit travel. In the seated or upright position, the leg rest is tucked underneath the front edge 98 of the seat out of the way at an angle of approximately 11° from the vertical, while in the fully reclined position, the leg rest is tilted up slightly from the front of the seat at an angle of approximately 5° from the horizontal so as to achieve the desired positional relationship between the thighs and lower legs when the body is in the zero gravity position. That angle is approximately 125°–135° (i.e. the angle between the seat and leg rest). This particular construction provides constant leg rest motion with respect to the seat and there is no sudden drop or rise of the leg rest during the reclining action.

Another feature of the present invention is the provision of a pivotal connection 125 joining the head rest section 122 and main section 124 of the backrest 16. The connection, preferably a friction-type hinge, enables the head rest portion 122 of the back rest 16 to tilt forwardly with respect to the main section 124 of the back rest approximately 22° degrees and will remain in any position selected by the chair user. This places the head of the occupant at a more comfortable angle for reading, particularly when the chair is in the fully reclined position of FIG. 4 and also assists the occupant in viewing television or conversing with a person disposed somewhat in front of the chair when the chair is fully reclined. This feature may or may not be included in the chair constructions, but when present, provides an additional measure of comfort for the occupant of the chair. The pivotal connection itself can take many different forms, and rather than being held in any selected position by friction, may have an actuator in the form of a handle or knob, with a screw to tighten and loosen the connection.

The zero gravity position is an important aspect of the present invention as it is the most stress-free way to sit. Specifically, it reduces pressure on the spine, relieves muscle tension, increases circulation, and reduces stress on the heart, thus relieving back pain and improving circulation.

Another aspect of the invention is the cam mechanism that enables the chair to move from the reclined to the upright position more easily than most conventional recliners available. The long motion of the body support afforded by the cam and the even distribution of the load imposed by the leg rest makes it particularly easy for the occupant of the chair to change the position of the body support and enables the seat to reach a more nearly level plane in the upright position, which in turn makes it easier, particularly for an elderly person, to get in and out of the chair. The continuous motion of the foot rest is yet another aspect of the present invention that distinguishes it from the conventional recliners presently on the market. In conventional recliners, as the body support begins its motion from the upright position toward the fully reclined position, the foot rest elevates very quickly during the first phase of the transition and achieves its fully elevated position with respect to the seat usually during the first half of the transition, toward the fully reclined position. Similarly, when conventional chairs move from the fully reclined to the upright position, the foot rest does not ordinarily change its angular relationship with respect to the seat until approximately the last half of the transition of the body support to the upright position, which makes it more difficult for the occupant to move the chair under the influence of his/her body weight, because the occupant has difficulty in raising his/her torso to a sitting position so as to move the center of gravity of the body over the center of the pivotal support.

From the foregoing description, those skilled in the art will recognize that numerous modifications may be made of this invention without departing from its spirit. Therefore, it is not intended to limit the breadth of the invention to the embodiments illustrated and described. Rather, the breadth of the invention is to be determined by the appended claims and their equivalents.

What is claimed is:

1. A reclining chair comprising:

a frame having a pair of spaced apart stationary side members having opposed inner sides, a rocker track mounted on the inner side of each of the side members, a rocker cam having an arcuate lower surface seated on each of said tracks for rocking to and fro on the track, a body support including a seat, backrest and leg rest carried by the rocker cams for rocking motion therewith, at least one stationary post mounted on the inner side of each of the side members and extending into arcuate tracks in each of the cams for preventing translational movement of the cams on the rocker tracks and limiting the rocking motion of the cams, a releasable lock operatively connected to one of the cams and the side member on which it is mounted for retaining for body support in selected positions between limits established by the posts and the ends of the arcuate tracks, a pivotal connection between the seat and leg rest enabling the leg rest to pivot from a first position substantially perpendicular to and below the seat to a second position wherein the leg rest is at approximately a horizontal position and at an obtuse angle to the seat, and a linkage connected to the frame and the leg rest for constantly changing an angular relationship between the leg rest and seat as the body support moves from one to the other of its extreme positions.

2. The reclining chair as defined in claim 1 wherein the seat and backrest are in a fixed angular relationship to one another.

3. The reclining chair as defined in claim 2 further comprising a bracket connected to each of the rocker cams and supporting the body support for rocking motion with each of the rocker cam on each of the tracks.

where the bracket has two flanges, one flange supports the seat and the other flange supports the backrest.

4. The reclining chair as defined in claim 1 wherein a pair of mounting brackets are mounted on the cams and carry the body support on the cams.

5. The reclining chair as defined in claim 1 wherein a pair of stationary posts are mounted on each of said side members and each extends into a separate arcuate track.

6. The reclining chair as defined in claim 5 wherein one of the posts on one of said side members comprises part of the releasable lock.

7. The reclining chair as defined in claim 5 wherein the at least one post in movable with the rocker cam and the arcuate track is fixed to the side member.

8. A reclining chair having a body support movable between an upright and a zero gravity reclining position comprising:

a stationary chair frame having a pair of opposed side members, a track on each of said side members and a rocker cam member having an arcuate surface seated on each of the tracks, a bracket connected to the cam members and supporting the body support for rocking motion with the cam members on the tracks, at least one post carried by one of the members and an arcuate slot receiving the post carried by the other of the members for limiting the extent of the rocking motion of the cam members on the tracks, and a locking member operatively connected to the side member and cam member for releasably retaining the body support in any selected position between the limits established by the post and slot.

9. The reclining chair as defined in claim 8 wherein the at least one post is movable with the cam member and the arcuate slot is fixed to the side member.

10. The reclining chair as defined in claim 8 wherein the post and slot form part of the locking member.

11. A reclining chair having a body support movable between an upright position and a zero gravity reclining position comprising:

a stationary chair frame having a pair of opposed side members, a track on having an arcuate surface seated on the tracks, a bracket connected to the cam members and supporting the body support for rocking motion with a cam member on the tracks, a pair of posts, the posts being carried by one of the pairs of members, and a pair of arcuate slots, wherein each of said slots receiving one post to confine the motion of the cam members on the tracks to a rocking motion, and a locking member operatively connected to the side member and cam member for retaining the body support in any selected position between the limits established by the posts and slots.

12. The reclining chair as defined in claim 11 wherein the at least one post and slot form part of the locking member.

13. The reclining chair as defined in claim 11 wherein the body support includes a backrest and a seat that are in a fixed relationship to one another through the rocking motion.

14. The reclining chair as defined in claim 13 wherein the bracket has two flanges, one flange supports the seat and the other flange supports the backrest.

15. The reclining chair as defined in claim 11 wherein the body support includes a seat, backrest and leg rest an wherein the leg rest is pivotally connected to the seat for changing an angular relationship of the seat and leg rest.

16. The reclining chair as defined in claim 15 wherein a linkage connects the leg rest to the frame causing the leg rest to pivot relative to the seat as the body support moves on the rocker cam.

17. The reclining chair as defined in claim 15 further comprising a pivotal connection between the seat and leg rest enabling the leg rest to pivot from a first position substantially perpendicular to and below the seat to a second position wherein the leg rest is at approximately a horizontal position and at an obtuse angle to the seat.

18. The reclining chair as defined in claim 11 wherein the posts are movable with the cam members and the slots are fixed to the side members.

19. The reclining chair as defined in claim 11 wherein the posts are fixed to the side members and the slots are movable with the cam members.

20. The reclining chair as defined in claim 8 wherein th e body support includes a backrest and seat that are in a fixed relationship to one another throughout the rocking motion.

21. The reclining chair as defined in claim 20 wherein the bracket has two flanges, one flange supports the seat and the other flange supports the backrest.

22. The reclining chair as defined in claim 8 wherein the body support includes a seat, backrest and leg rest and wherein the leg rest is pivotally connected to the seat for changing on angular relationship of the seat and leg rest.

23. The reclining chair as defined in claim 22 further comprising a pivotal connection between the seat and leg rest, enabling the leg rest to pivot from a first position substantially perpendicular to and below the seat to a second position wherein the leg rest is at approximately a horizontal position and at an obtuse angle to the seat.

24. The reclining chair as defined in claim 22 wherein a linkage connects the leg rest to the frame causing the leg rest to pivot relative to the seat as the body support moves on the rocker cam members.

25. The reclining chair as defined in claim 8 wherein the posts are fixed to the side members and the slots are movable with the cam members.

26. A reclining chair comprising, a stationary frame having a pair of side members and a body support disposed between the side members, and a mechanism carrying the body support in the side members permitting the body support to move between an upright position and a fully reclined position on the frame, said mechanism including on each side of the body support, a track having a flat surface and carried by each of the side members, a pair of cam members having a lower arcuate surface that sits on the flat surface of each the tracks and connected to the side of the body support, a pair of fixed posts mounted on one of the pairs of members and registering with a pair of slots in each of the other pair of members, said posts and slots limiting forward and backward motions of the cam members on the flat surfaces, to define upright and fully reclined positions of the body support, and a locking device operatively connecting the frame and body support to retain the body support in any selected position between the upright and fully reclined positions.

27. The reclining chair as defined in claim 26 wherein one of the posts and one of the slots are pat of the locking device.

28. The reclining chair as defined in claim 26 wherein the body support includes a seat, back rest and extension of the back rest for supporting the head of the occupant of the body support, and a pivotal connection joining the backrest and the extension enabling the extension to be tilted forwardly for supporting the head in a plurality of positions selected by the occupant.

* * * * *